US005701998A

United States Patent [19]

Perry et al.

[11] Patent Number: 5,701,998

[45] Date of Patent: Dec. 30, 1997

[54] BASEBALL BAT COVERS

[76] Inventors: Eric J. Perry, P.O. Box 411; Thomas J. Frey, 258 W. Main St., both of Norwalk, Ohio 44857

[21] Appl. No.: 503,614

[22] Filed: Jul. 18, 1995

[51] Int. Cl.[6] ..... A63B 59/06; B65D 85/20

[52] U.S. Cl. ..... 206/315.1; 16/111 R; 473/564

[58] Field of Search ..... 206/315.1, 315.9, 206/579; 16/110 R, 111, 112, 113, 114 R; 150/154, 155, 163; 273/26 B, 72 A, 72 R, 75; 473/457, 564, 568

[56] References Cited

U.S. PATENT DOCUMENTS

| | | | |
|---|---|---|---|
| 1,006,895 | 10/1911 | Albree | 16/111 R |
| 1,019,662 | 3/1912 | Kroder | 16/111 R |
| 1,084,969 | 1/1914 | Sargent | 16/110 R |
| 1,165,484 | 12/1915 | Zimmerman | 473/568 |
| 2,906,244 | 9/1959 | Christensen | 16/111 R |
| 3,189,069 | 6/1965 | Stowell | 16/110 R |
| 3,927,466 | 12/1975 | Rosalsky | 273/72 A |
| 4,662,415 | 5/1987 | Proutt . | |
| 4,838,416 | 6/1989 | Carman . | |
| 4,890,731 | 1/1990 | Mroz . | |
| 5,107,995 | 4/1992 | Simpson . | |
| 5,118,107 | 6/1992 | Bucher . | |
| 5,133,395 | 7/1992 | Moore . | |
| 5,203,390 | 4/1993 | Eckstein . | |
| 5,224,602 | 7/1993 | Bettles et al. . | |
| 5,390,572 | 2/1995 | Gakhar | 16/111 R |

FOREIGN PATENT DOCUMENTS

| | | | |
|---|---|---|---|
| 1188550 | 4/1970 | United Kingdom | 16/111 R |
| 2031738 | 4/1980 | United Kingdom | 273/26 B |

*Primary Examiner*—Jimmy G. Foster
*Attorney, Agent, or Firm*—Richard C. Litman

[57] ABSTRACT

A bat handle cover for encasing the grip area of a bat handle and for suspending the bat by a chain and clasp from a suspending structure. The cover may be made of stiff material, and include either a number of locking balls, a ring or a pair of U-shaped latches near the inside top of the cover, which grasp the bat handle just below the enlarged butt end or head of a conventional baseball bat. The cover may be made of flexible material, and include a necked-in portion which engages the bat. The flexible cover may have a full length slit closed by hook and loop fasteners about the bat handle, or a zipper closure running most of the length of the cover. A lower, open end of the cover may include a seal, to prevent water, moisture and/or debris from entering the interior of the cover.

8 Claims, 4 Drawing Sheets

BASEBALL BAT COVERS

BACKGROUND OF THE INVENTION

1. Field of the Invention

The present invention relates to a covers for baseball bats. The cover protects the bat grip from rain, dirt and damage when it is not being used. The cover grasps the bat grip and has a suspension chain so that the bat may be hanged for storage; the chain also functions as a convenient carrying device.

2. Description of the Prior Art

Typically constructed from wood or metal, baseball bats may have a covering such as a cloth tape wrap or a padded material permanently or temporarily affixed to the grip or handle. Such coverings provide a more comfortable and more secure grip than can be had from a bare bat. However, such coverings do little to protect the bat from the elements and the bat may be seriously damaged by repeated exposure to moisture. Moreover, the security of a batter's grasp on a water-logged bat handle covering can be so compromised that a safe and secure grip becomes impossible. As an example, pity a player or spectator who gets hit by a bat accidently released during a swing.

Wooden bats are especially susceptible to damage caused by knocks which can weaken and splinter the wood. Once thus weakened, a bat's useful life span can be drastically shortened. Carelessly tossed into the back of a car, the bat may bounce around, causing damage not only to the bat itself but also to the car. Storage of a bat during the off-season, or even on the field when it is not being used, means either propping the bat up against a fence or wall, or laying it on the ground unless a bat rack is provided. Finally, carrying several bats can be difficult owing to the unwieldiness of their form.

Although carrying bags and cases have been designed to carry baseball bats and related equipment, these cases are clumsy and may not fully protect the bat grip. When a bat is actually being used during a game, the cases are inconvenient for quickly covering the bat grip in the event of sudden, inclement weather.

In a preferred embodiment of the instant invention, the baseball cover is a rigid, shock-absorbing tube in which a baseball bat may be secured. In another preferred embodiment, a waterproof, zippered sleeve with a hanging chain or the like is configured to cover a baseball bat grip. In yet another preferred embodiment, the baseball bat cover is a lightweight plastic cover that has a hanging chain or the like and a fastener such as velcro® (i.e., hook and loop fasteners). Each of these embodiments permits one to cover the grip of a baseball bat quickly and easily, the cover providing protection for the bat handle from the elements and minor knocks and allows a user to hang the bat for either permanent or temporary storage. Common to all the embodiments of the invention is internal structure or overall form for grasping the bat handle or grip below or forwardly of the handle end so that the cover is securely fastened to the bat when in place over the grip or handle.

Relevant prior art disclosures will now be discussed in their order of perceived relevance. U.S. Pat. No. 5,118,107 issued to J. M. Bucher on Jun. 2, 1992, shows a waterproof, zippered sleeve rain cover for a golf club handle. The external surface of the cover is textured and, when secured about the handle of a golf club, envelopes and protects the club grip from rain. A user who is playing golf in the rain can maintain a good grasp on the covered golf club which would become wet and slimy when exposed to rain. A finger ring may be grasped as the zipper pull is employed to enclose the golf club grip with the sleeve. However, the ring is unsuitable for suspending or hanging the club. Also, unlike the shaft of a golf club, a baseball bat tapers near the end and terminates in a wide butt end. The golf club rain cover is a tapered sleeve whose design is unsuitable for covering a baseball bat. The instant invention and the rain cover also diverge functionally; whereas the rain cover is a supple covering which makes it possible to use a golf club in the rain it offers no substantive protection from bumps and knocks to the club shaft.

U.S. Pat. No. 5,203,390 issued to D. L. Eckstein on Apr. 20, 1993, demonstrates another cover for a golf club grip which is a waterproof tubular sack, closed with a cinch and lined with terry cloth. Similar to the Bucher rain cover, this device is unsuitable for use with a baseball bat and is incapable of protecting the bat from damage.

U.S. Pat. No. 4,836,416 issued to E. R. Carman on Jun. 13, 1989, shows a golf club holster in the form of a tapered tubular shaft that has an external hook. A golf club such as a putter may be inserted upside down into the holster, and the holster may be hung by the hook to a golf bag. Unlike the instant invention, this device cannot secure a bat; the Carman holster has no grasping structure. In function, it serves as an ancillary holder for a favorite club rather than as a protecting device. On the other hand, in every embodiment of the instant invention, the baseball bat cover is not merely a holder, but is also a securing and protecting device.

U.S. Pat. No. 5,133,395 issued to W. C. Moore on Jul. 28, 1992, shows a golf club protector which is a tapered cloth sleeve suitable for covering a single golf club. A golf club is inserted shaft end first into the protector to be enveloped by the sleeve. Excess sleeve material is left to overhang the top of the inverted club. The simplicity desired in the manufacture of this device necessitates that it is incapable of being reasonably secure about the golf shaft. Moreover, clubs covered by this device would still be carried in a golf bag since the cover fails to provide an alternative carrying structure. In contradistinction, the instant invention provides a baseball bat cover which is secured about the baseball bat, provides protection for the bat handle or grip, and facilitates carrying and storage of the bat.

U.S. Pat. No. 4,890,731 issued to E. J. Mroz on Jan. 2, 1990, teaches a personal sports equipment carrying case resembling a brief case that has recesses formed into the end panels to receive bats. Baseball bats may be carried and partially covered by the carrying case by inserting the bats into the recesses. The compartment formed by the walls of the carrying case can also contain balls and other equipment. U.S. Pat. No. 5,224,602 issued to C. J. Bettles et al. on Jul. 6, 1993, shows another carrying case in which several bats and balls may be toted. A rack is built into the main compartment of the case and holds bats in place when the case is closed shut. Both of these carrying cases have handles for carrying means. Clearly, these devices are utterly unlike the instant invention both in design as well as in function. The baseball bat cover of the instant invention presents a trim and efficient design which increases the bulk of a baseball bat by a negligible amount while providing carrying and protecting structure.

U.S. Pat. No. 5,107,995 issued to C. R. Simpson on Apr. 28, 1992, shows an elongated strap for holding a surfboard or other elongated item. The strap has a pocket at its lower end which may fit around the tip of a surfboard in the fashion of a sling. The strap covers the bottom face of the surfboard and has slits through which the fins of the surfboard may protrude.

U.S. Pat. No. 4,662,415 issued to G. R. Proutt on May 5, 1987, demonstrates a cover which is fabricated as a permanent gripping surface mounted to the exterior of a golf club handle. In function, this cover is similar to covers already found on many baseball bats. However, the baseball bat cover of the instant invention is a temporary cover which is designed to protect the handle or grip during storage and transit.

None of the above inventions and patents, taken either singly or in combination, is seen to describe the instant invention as claimed.

SUMMARY OF THE INVENTION

Accordingly, it is a principal object of the invention to provide a baseball bat handle cover for the bat grip or handle which securely grasps the handle.

It is another object of the invention to provide a baseball bat handle cover that, in place, can be used to suspend or hang the bat; the cover functions as an individual bat rack.

It is a further object of the invention to provide a sturdy, hard material bat handle cover having internal structure for securely grasping the handle when in place.

Still another object of the invention is to provide a bat handle cover which is fabricated from a relatively supple material, the cover being configured so as to securely grasp the bat by its handle when the cover is in place.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a baseball bat cover for the bat handle or grip which provides protection for the handle area, the handle cover also being useful for suspending or hanging the bat; thus, the cover also functions as an individual bat rack. Two general forms include hard cover and soft cover versions.

Figure 5:
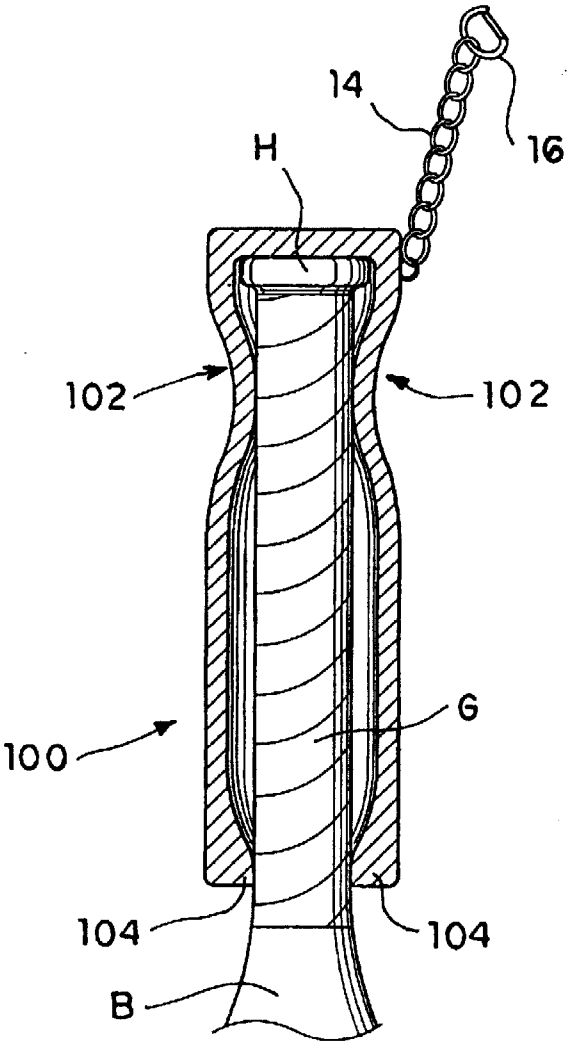
FIG. 5 is a sectional view of an embodiment of a relatively soft or supple material cover according to the instant invention.
Figure 7:
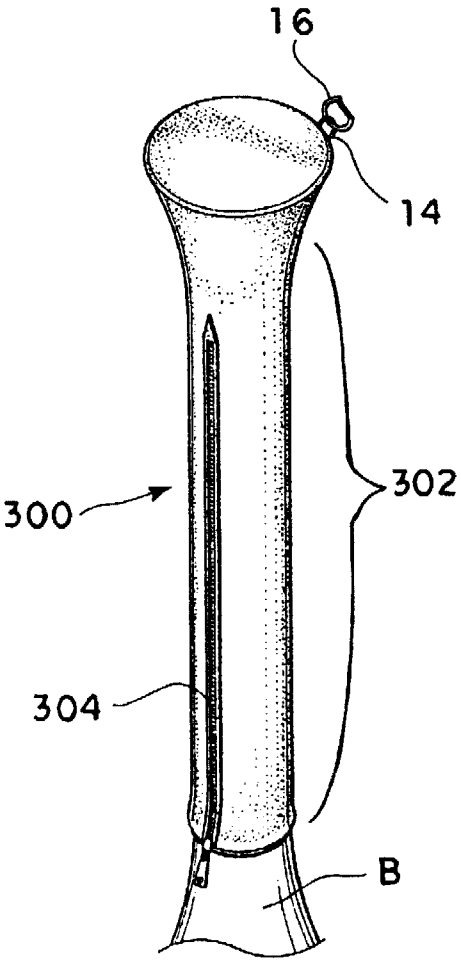
FIG. 7 is an environmental perspective view of yet another, soft material cover embodiment of the invention.
Figure 6:
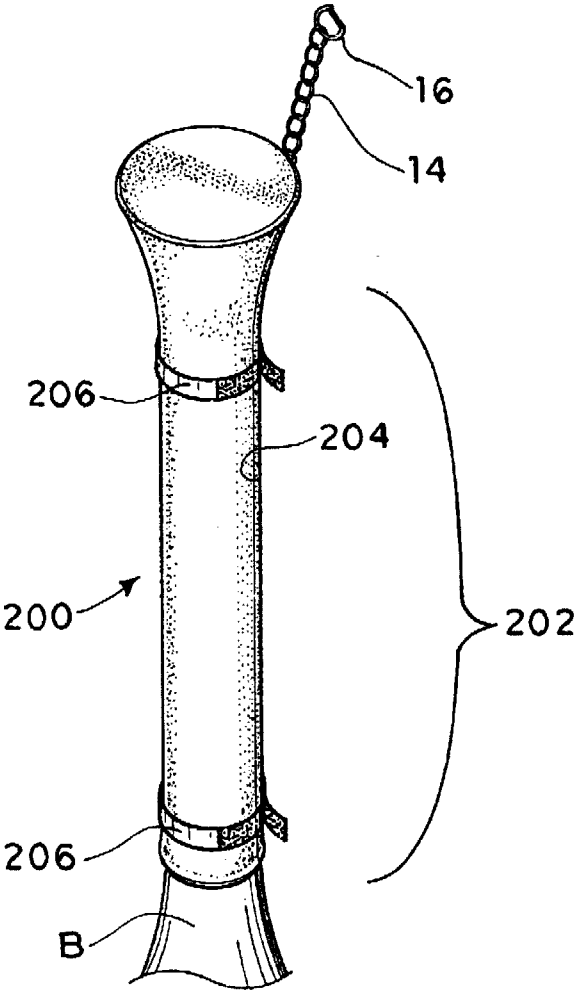
FIG. 6 is an environmental perspective view of another, soft material cover embodiment of the invention.

Referring now to the drawings, various embodiments of hard cover versions of the invention are seen in FIGS. 1–4, while several soft cover versions are seen in FIGS. 5–7.

Figure 1:
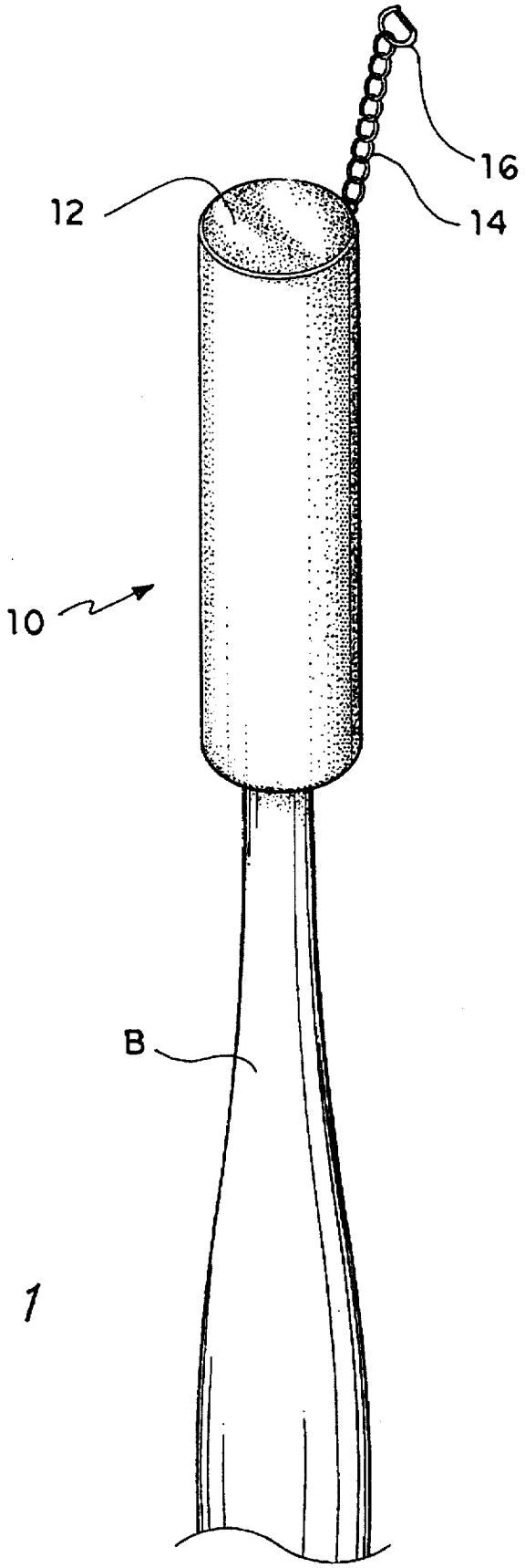
FIG. 1 is an environmental perspective view of one preferred embodiment of the instant invention, a hard material cover, in place over a baseball bat, which is partially illustrated.

With reference to FIG. 1, cover 10 having a closed end cap 12 is seen, in place over the handle or grip end G (see FIG. 2A) of an otherwise conventional baseball bat B. The hard cover embodiments of the invention, as herein disclosed, all have about the same external appearance. At the approximate junction of the cap and main body of the cover is a suspension or hanging structure in the form of a chain 14 with a clasp or lock device 16 at the upper free end thereof. Clasp 16 is of conventional structure and forms no part of the instant invention per se. Of course, the clasp 16 functions to suspend or hang the cover with the bat secured therein from any convenient structure, e.g., on a chain link fence, so that the cover serves essentially as an individual bat rack. As for the fabrication of the chain, it could be a strap, or a section of rope, or any other suitable device for suspending the bat and its handle cover. As for the term "bat," it is meant to include all similar structures, sports environment or otherwise, having a handle section or portion with an enlarged head or butt end H as is seen in FIG. 2*a*.

Figure 2A:
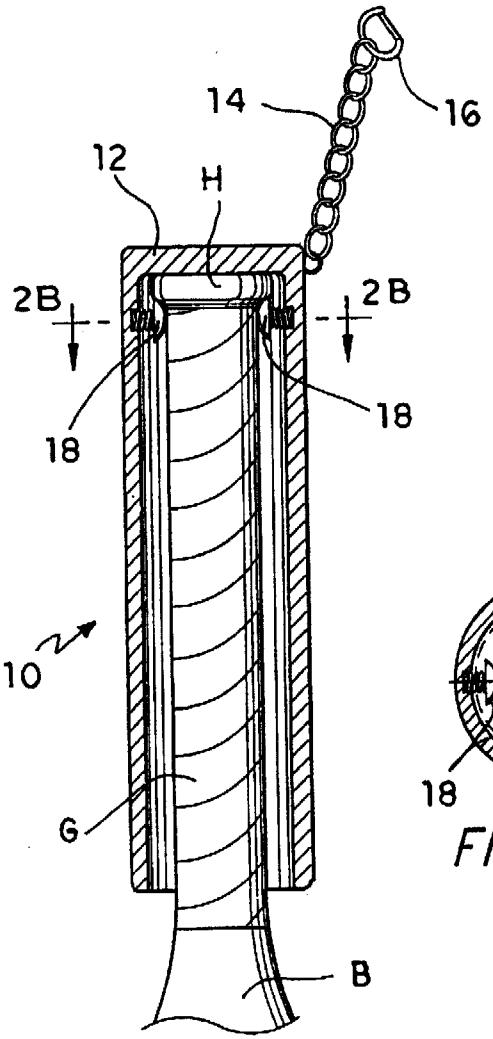
FIG. 2A is a sectional view of the cover seen in FIG. 1.
Figure 2B:
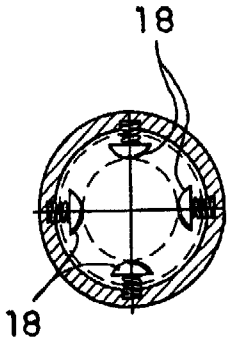
FIG. 2B is a cross sectional view taken along lines 2B—2B of FIG. 2A.

Turning now to FIGS. 2A and 2B, a first embodiment of the bat cover of this invention will be discussed. Cover 10 is fabricated from any one of a number of suitable materials including plastic, metal, hard leather or the like, etc., but plastic is the likely choice. Cover 10 has a series of four circumferentially positioned, spring loaded semispherical latching balls 18 therewithin, strategically placed near the upper end of the cover interior so as to securely lock against and just beneath the head end H of the bat as can be readily appreciated from an inspection of FIG. 2A. The compression strength of each of the springs of the latching balls 18 is sufficient so that the bat may be suspended and held by the cover, yet the cover may be easily removed from the bat by simply pulling the bat and the cover apart. Equally importantly, it will be appreciated that the cover is both easily and very rapidly placed over the bat when desired, particularly when the weather turns bad, as is often the case when baseball is played during a hot, summer afternoon.

Figure 3A:
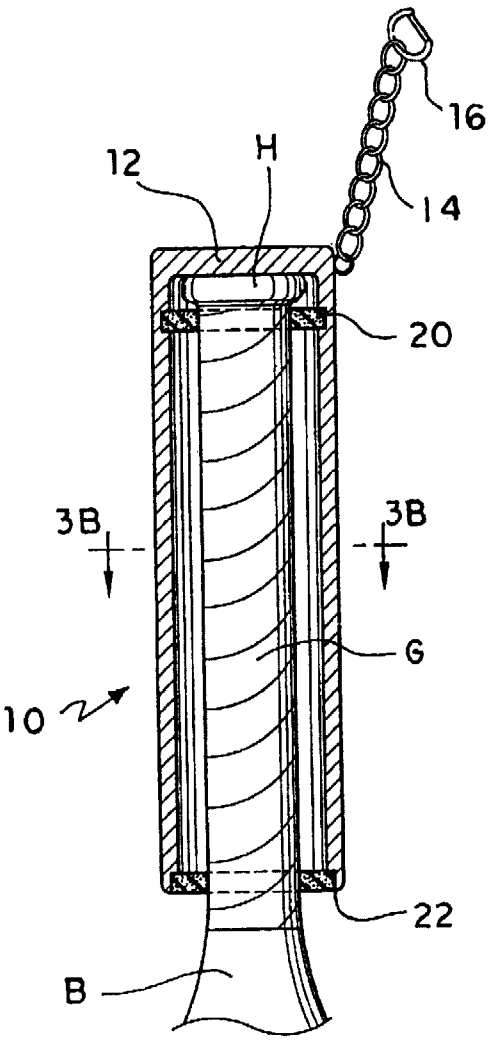
FIG. 3A is a sectional view similar to FIG. 2A but showing another embodiment of the invention.
Figure 3B:
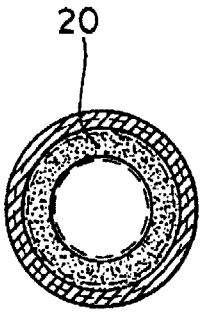
FIG. 3B is a cross sectional view taken along lines 3B—3B of FIG. 3A.

Turning now to FIGS. 3A and 3B, a second embodiment of the invention is disclosed. In place of the balls 18 is a ring 20 of relatively stiff rubber or the like which functions to retain the cover in place as previously described. Also, the bottom of the cover 10 may be provided with a seal ring 22 secured therewithin by any suitable means (glue, for example); this ring 22 serves to discourage the entry of water, dirt and debris into the interior of the cover when the cover is in place, as shown. Furthermore, the use of seal ring 22 is not limited to this embodiment; it may be provided with the embodiments shown in FIGS. 2A–2B and 4A–4B as well.

Figure 4B:
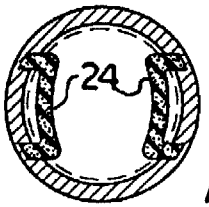
FIG. 4B is a cross sectional view taken along lines 4B—4B of FIG. 4A.
Figure 4A:
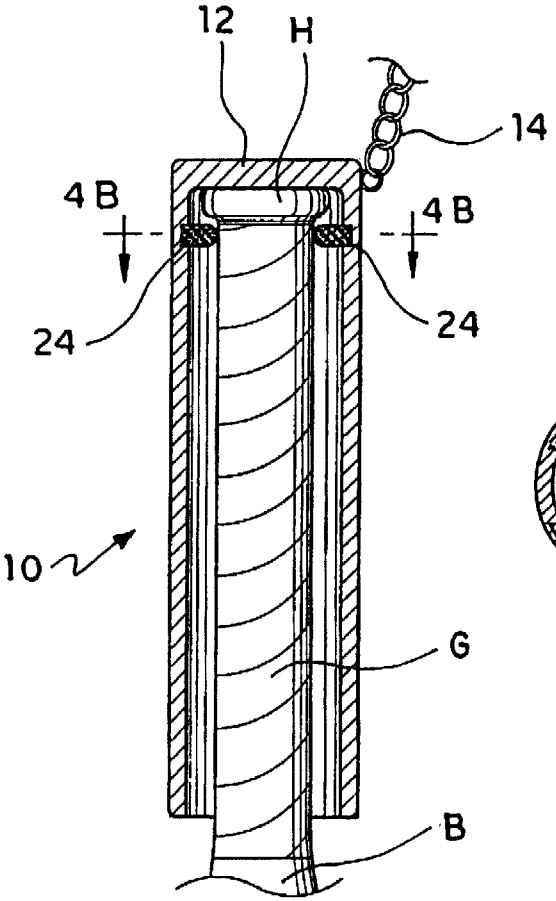
FIG. 4A is a sectional view similar to FIG. 2A but showing yet another embodiment of the invention.

A third embodiment of the invention is shown in FIGS. 4A and 4B. Here, instead of the latching balls or ring previously described, a pair of opposed, synthetic material, U-shaped latches 24 are positioned in the upper interior of the cover and function to retain the cover in place, just as described above with respect to the first two embodiments of the invention.

As set forth above, a relatively softer material cover for the invention is shown in the embodiments illustrated by FIGS. 5, 6 and 7. A chain 14 and clasp 16 may be provided as in the embodiments described hereinbefore.

Referring to the one-piece, unitary cover shown in FIG. 5, this cover 100 may be made of a flexible material, the flexibility coefficient ranging from fairly supple to semi-rigid. A necked-in portion 102 is formed near a top portion thereof, which is of sufficient reduced diameter so as to allow the portion to grasp the bat handle H. Now, the material of which the cover 100 is made needs to be sufficiently pliable so as to be easily fitted by hand over the bat handle and head end. A number of rubber compounds and plastic materials are available, from which cover 100 may be fabricated. Near the bottom of cover 100 is formed a peripheral seal member 104 which functions in the same manner as seal 22, described above.

Turning now to FIGS. 6 and 7, in FIG. 6, a cover 200 is seen, having a necked-in portion 202 which runs the full length of the cover, except of course for the top portion which surrounds the butt end or head of the baseball bat. The cover 200 is secured to the bat by provision of a slit 204, which allows the cover to be opened at place around the bat handle, and a pair of hook and loop strap fasteners 206 are strategically located so as to close the slit and secure the cover in place. These straps could have buckle ends, if desired (not shown) and may be separate from the cover 200. Alternatively, the straps can be secured directly onto the cover 200 with the fastener ends left free. The construction of cover 300 seen in FIG. 7 is similar as to the overall configuration of the cover and its necked-in portion 302. However, a zipper closure 304 is provided to close the cover about a bat handle.

It is to be understood that the present invention is not limited to the embodiments described above, but encompasses any and all embodiments within the scope of the following claims.

We claim:

1. A bat handle cover comprising:

a cover of generally tubular configuration having a closed end and an opposite open end, said cover dimensioned and configured to enclose a bat handle having an enlarged head;

a flexible sealing ring mounted within said cover at said open end, said sealing ring for engaging a surface of the bat handle to deter entrance of debris past said sealing ring into said cover; and a suspension ring permanently affixed to said cover proximate said closed end for removably grasping the bat handle within said cover upon insertion of the enlarged head through said suspension ring, whereby the bat handle is suspended within said cover.

2. The bat handle cover according to claim 1, wherein said cover is fabricated of a stiff, inflexible material.

3. A bat handle cover comprising:

a cover of generally tubular configuration having a closed end and an opposite open end, said cover dimensioned and configured to enclose a bat handle having an enlarged head;

a suspension ring permanently affixed to said cover proximate said closed end for removably grasping the bat handle within said cover upon insertion of the enlarged head through said suspension ring, whereby the bat handle is suspended within said cover; and suspension means attached to said cover at said closed end for hanging suspension of said cover.

4. The bat handle cover according to claim 3, said suspension means fabricated as a length of chain, there further being clasp means on a free end of said chain for attachment to a suspending structure, whereby said cover functions as an individual bat rack.

5. A bat handle cover comprising:

a cover of generally tubular configuration having a closed end and an opposite open end, said cover dimensioned and configured to enclose a bat handle having an enlarged head;

a first generally U-shaped latch permanently affixed to said cover proximate said closed end; and a second generally U-shaped latch spaced apart from said first latch, said second latch permanently affixed to said cover proximate said closed end opposite said first latch, said first latch and said second latch removably grasping the bat handle within said cover upon insertion of the enlarged head between said first latch and said second latch, whereby the bat handle is suspended within said cover.

6. The bat handle cover according to claim 5, further including a flexible sealing ring mounted within said cover at said open end, said sealing ring for engaging a surface of the bat handle to deter entrance of debris past said sealing ring into said cover.

7. The bat handle cover according to claim 5, further comprising suspension means attached to said cover at said closed end for hanging suspension of said cover.

8. The bat handle cover according to claim 7, said suspension means fabricated as a length of chain, there further being clasp means on a free end of said chain for attachment to a suspending structure, whereby said cover functions as an individual bat rack.

* * * * *